US011285524B2

(12) United States Patent
Muradov

(10) Patent No.: US 11,285,524 B2
(45) Date of Patent: Mar. 29, 2022

(54) WEAR RESISTANT TUBULAR MEMBERS AND SYSTEMS AND METHODS FOR PRODUCING THE SAME

(71) Applicant: NATIONAL OILWELL VARCO, L.P., Houston, TX (US)

(72) Inventor: Andrei Muradov, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 16/904,192

(22) Filed: Jun. 17, 2020

(65) Prior Publication Data

US 2021/0394249 A1 Dec. 23, 2021

(51) Int. Cl.
*B21D 39/20* (2006.01)
*E21B 17/10* (2006.01)

(52) U.S. Cl.
CPC ..... *B21D 39/20* (2013.01); *E21B 17/1085* (2013.01)

(58) Field of Classification Search
CPC .... B21D 22/025; B21D 22/06; B21D 26/033; B21D 26/043; B21D 26/039; B21D 26/041; B21D 26/047; B21D 15/04; B21C 37/156; B21C 37/158; B21C 37/155; B21J 5/08; E21B 17/1085
See application file for complete search history.

(56) References Cited

U.S. PATENT DOCUMENTS 1,041,999 A * 10/1912 Hansen ..... B21J 5/02 72/355.6
1,104,088 A * 7/1914 Wales ..... F16B 37/065 29/512
1,882,352 A * 10/1932 Woodhead ..... B21K 21/12 29/897.2
1,945,092 A * 1/1934 Storer ..... B21J 1/06 72/340
2,001,981 A * 5/1935 Siviter ..... B21J 5/08 470/11
2,089,784 A * 8/1937 Cornell, Jr. ..... B21K 1/56 285/148.9
2,142,239 A * 1/1939 Charles ..... B21J 5/08 72/322
2,313,116 A * 3/1943 Babcock ..... B21J 1/06 72/342.1
3,209,453 A * 10/1965 Bertoglio ..... B21J 5/08 72/355.6
3,224,243 A * 12/1965 Van ..... B21J 9/06 72/359
3,611,768 A * 10/1971 Odagaki ..... B21D 15/06 72/58
4,838,062 A * 6/1989 Prenn ..... B21J 1/06 72/318
5,184,495 A * 2/1993 Chunn ..... B21J 5/08 72/318

(Continued)

*Primary Examiner* — Jason L Vaughan
(74) *Attorney, Agent, or Firm* — Conley Rose, P.C.

(57) ABSTRACT

Some embodiments disclosed herein are directed to a tubular member including a central axis, a first end, a second end opposite the first end, an upset region between and axially spaced from the first end and the second end, and a first outer diameter axially spaced midway between the first end and the upset region. The upset region includes a second diameter which is larger than the first diameter, does not include a weld joint, and includes redistributed material from the tubular member.

8 Claims, 5 Drawing Sheets

(56) References Cited

U.S. PATENT DOCUMENTS

| | | | | |
|---|---|---|---|---|
| 5,274,921 | A * | 1/1994 | Kawagoe | B21D 53/16 29/898.059 |
| 5,379,625 | A * | 1/1995 | Hale | B21D 41/04 72/318 |
| 5,437,342 | A * | 8/1995 | Powada | E21B 17/1085 166/242.1 |
| 5,895,324 | A * | 4/1999 | Inada | B21J 5/08 470/11 |
| 5,956,988 | A * | 9/1999 | Beste | B21J 5/08 72/57 |
| 7,360,387 | B2 * | 4/2008 | Otaki | B21J 5/08 72/353.2 |
| 7,644,601 | B2 * | 1/2010 | Brochheuser | B21C 37/16 72/283 |
| 7,647,802 | B2 * | 1/2010 | Knirk | B21K 21/12 72/115 |
| 8,783,344 | B2 | 7/2014 | Aung et al. | |
| 9,561,537 | B2 * | 2/2017 | Kirby | E21B 7/046 |
| 9,821,365 | B2 * | 11/2017 | Colosseo | B21D 26/033 |
| 10,514,113 | B2 * | 12/2019 | Kubota | B21D 22/025 |
| 2002/0054972 | A1 * | 5/2002 | Charpentier | E21B 17/1085 428/36.91 |
| 2018/0318910 | A1 * | 11/2018 | Yoshida | B21K 1/063 |
| 2019/0076902 | A1 * | 3/2019 | Mizumura | B21C 37/065 |

* cited by examiner

WEAR RESISTANT TUBULAR MEMBERS AND SYSTEMS AND METHODS FOR PRODUCING THE SAME

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Elongate tubulars are used in many industrial applications, such as, for example, oil and gas drilling and production. In particular, in oil and gas drilling operations, a drill bit is threadably attached at one end of a tubular and then is rotated (e.g., from the surface, downhole by a mud motor, etc.) in order to form a borehole within a subterranean formation. As the bit advances within the subterranean formation, additional tubulars are attached (e.g., threadably attached) at the surface, thereby forming a drill string which extends the length of the borehole.

BRIEF SUMMARY

Some embodiments disclosed herein are directed to a tubular member including a central axis, a first end, a second end opposite the first end, an upset region between and axially spaced from the first end and the second end, and a first outer diameter axially spaced midway between the first end and the upset region. The upset region includes a second diameter which is larger than the first diameter, does not include a weld joint, and includes redistributed material from the tubular member.

Additionally, some embodiments herein are directed to a method including coupling a tubular member to a die assembly, the tubular member includes a central axis, a first end, a second end opposite the first end, and an upset region between and axially spaced from the first end and the second end. In an embodiment, the method includes defining a cavity between the die assembly and the upset region. Additionally, some embodiments may include applying an axial load to the tubular member, and expanding an outer diameter of the tubular member into the cavity along the upset region.

Still other embodiments disclosed herein are directed to a system for manufacturing a tubular member. The tubular member includes a central axis, a first end, a second end, a throughbore extending between the first end and the second end, and an outer surface extending between the first end and the second end. The outer surface includes a central portion that is spaced from the first end and the second end along the axis. In some embodiments, the system includes a mandrel configured to be inserted within the throughbore and a die assembly including a cavity. The die assembly is configured to be disposed about the outer surface such that the central portion is aligned with the cavity. In addition, the system may further include a ram configured to apply a load to the tubular member along a central axis of the tubular member to expand the central portion of the outer surface into the cavity to form an upset region along the tubular member.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 2:
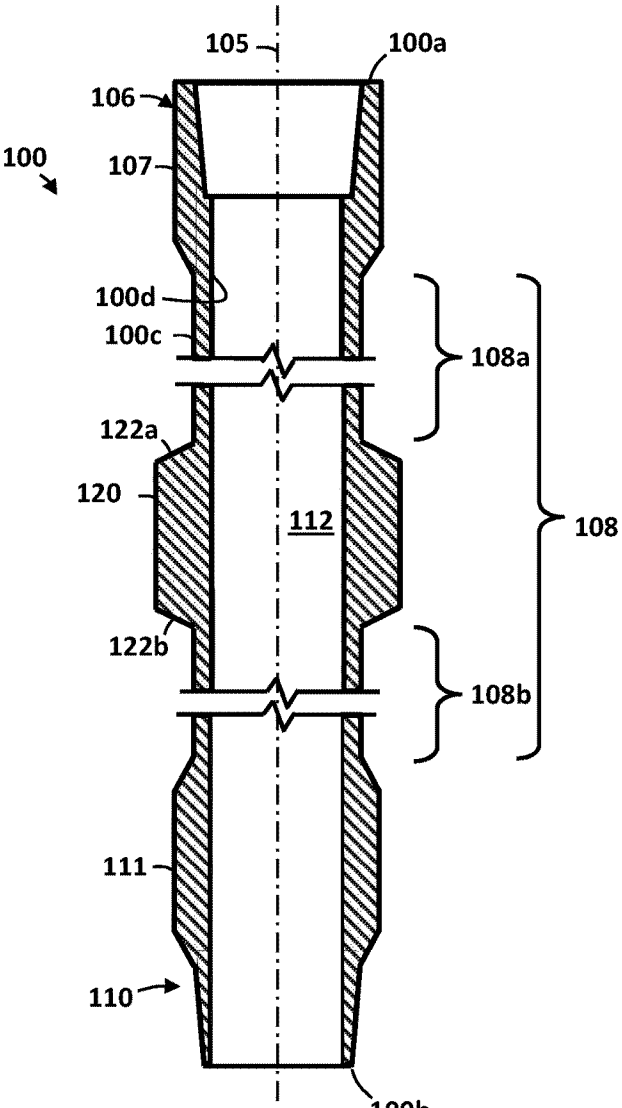
FIG. 2 is a cross-sectional view of a tubular member for use within the drilling system of FIG. 1 according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%. Any reference to up or down in the description and the claims is made for purposes of clarity, with "up", "upper", "upwardly", "uphole", or "upstream" meaning toward the surface of the wellbore or borehole and with "down", "lower", "downwardly", "downhole", or "downstream" meaning toward the terminal end of the wellbore or borehole, regardless of the wellbore or borehole orientation.

In addition, as used herein, the term "threads" broadly refer to a single helical thread path, to multiple parallel helical thread paths, or to portions of one or more thread paths, such as multiple troughs or trough portions axially spaced-apart by crests.

As previously described above, during a borehole drilling operation, a drill bit is mounted on the lower end of a drill string and is rotated by rotating the drill string at the surface, by actuation of downhole motors or turbines, or both. With weight applied to the drill string, the rotating drill bit engages a subterranean formation and proceeds to form a borehole along a predetermined path toward a target zone. During these drilling operations, the drill string (or portions thereof) may engage the sidewall of the borehole thereby resulting in wear along the outer surface of the drill string. Such engagement may be particularly pronounced in horizontal drilling operations where the path of the borehole departs from vertical. Such wear along the outer surface of the drill string may reduce the strength and service life of the comprising tubular members.

Accordingly, embodiments disclosed herein include tubular members and methods for producing tubular members, which may have a greater service life and durability than standard tubular members. In particular, the disclosed systems and methods may provide tubular members for drill strings which have increased fatigue resistance, wear resistance, and or damage tolerance.

Figure 1:
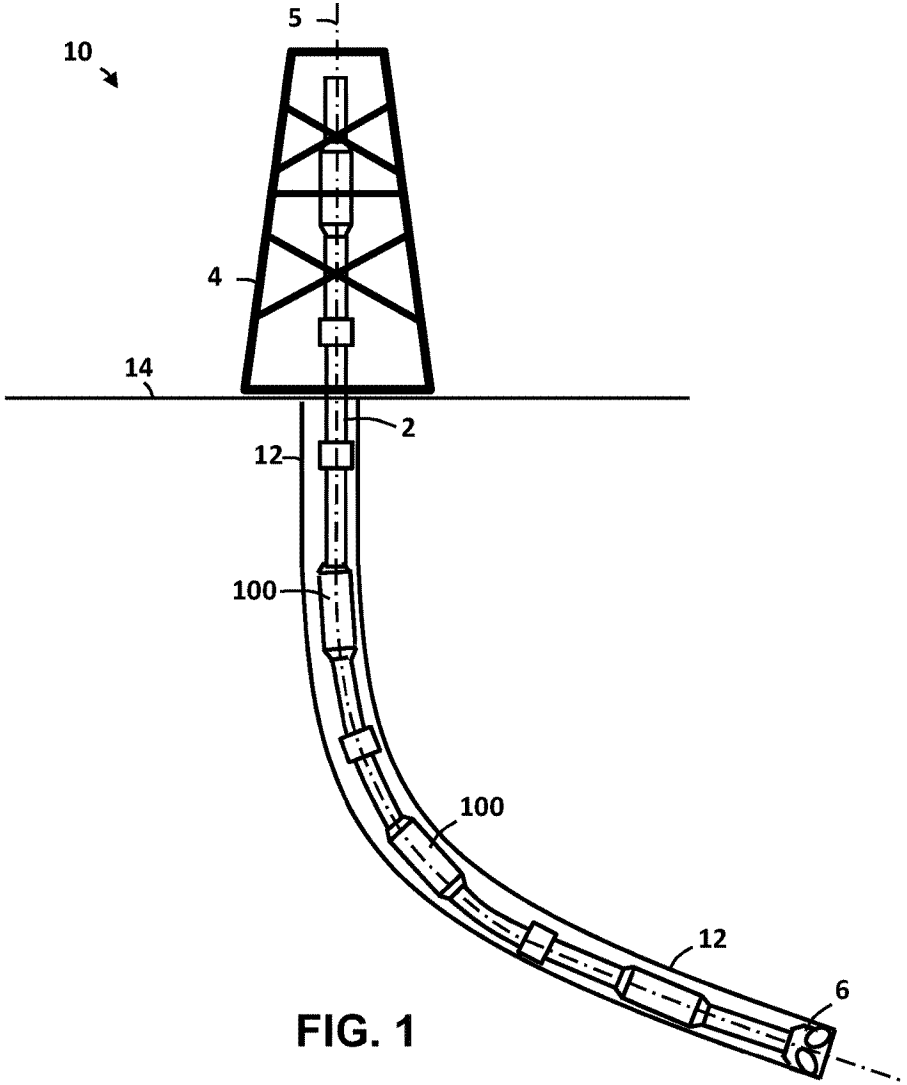
FIG. 1 is a schematic view of a drilling system including a tubular member according to some embodiments.

FIG. 1 is a schematic diagram showing an embodiment of a well system 10 for forming a borehole 12 is shown. Well system 10 generally includes a derrick 4 disposed at the surface 14, a drill string 2 extending along an axis 5 from the derrick 4 into borehole 12, and a drill bit 6 coupled to a downhole end of the drill string 2. Drill string 2 comprises one or more (e.g., a plurality of) tubular members 100, which may also be referred to herein as drill pipe, coupled together in an end-to-end fashion to form drill string 2. With weight applied to drill string 2 and or drill bit 6, drill bit 6 may be rotated (e.g., with a top drive disposed at the surface, a mud motor disposed within borehole 12, etc.) to form borehole 12. Borehole 12 may be oriented generally vertical (e.g., aligned with the direction of gravity), horizontal (e.g., extending perpendicularly to the direction of gravity), and/or at some angle therebetween. Although FIG. 1 shows a land-based drilling system, embodiments of the systems and methods disclosed herein are also applicable to off-shore well drilling systems.

Referring now to FIG. 2, each tubular member 100 making up drill string 2 (see e.g., FIG. 1) is an elongate tubular member that is configured to be threadably connected to each adjacent tubular member 100 or other component (e.g., drill bit 6, a bottom hole assembly (BHA), etc.). Generally speaking, each tubular member 100 includes a central or longitudinal axis 105, which may be aligned with axis 5 of drill string 2 during operations, a first or upper end 100*a*, a second or lower end 100*b* opposite upper end 100*a*, a radially outer surface 100*c* extending axially between ends 100*a*, 100*b*, and a radially inner surface 100*d* defining a throughbore 112 that also extends axially between ends 100*a*, 100*b*. In some embodiments, throughbore 112 is concentrically aligned with axis 105. In addition, in some embodiments (e.g., such as the embodiment of FIG. 2), throughbore 112 may have a substantially constant inner diameter between ends 100*a*, 100*b*. However, in other embodiments, throughbore 112 may have an inner diameter which varies between ends 110*a*, 100*b* (e.g., narrows along end 100*a* and or end 100*b*).

A threaded connector is disposed at each end 100*a*, 100*b* to facilitate the threaded connection of tubular members 100 within drill string 2 as previously described. In particular, a first threaded connector 106 is disposed at first end 100*a* and a second threaded connector 110 is disposed at second end 100*b*. In some embodiments, first threaded connector 106 comprises a female threaded connector, which may be referred to herein as a box connector 106, while the second threaded connector 110 comprises a male threaded connector, which may be referred to herein as a pin connector 110. Box connector 106 may comprise one or more internal threads, while the pin connector 110 may comprise one or more external threads. In some embodiments, first end 100*a* may be disposed uphole of second end 100*b* within drill string 2. Thus, along drill string 2 of FIG. 1, pin connector 110 of a first tubular member 100 may be threadably engaged with box connector 106 of an axially adjacent, second tubular member 100 that is positioned downhole from first tubular member 100. The thread profile along box connector 106 and pin connector 110 may be any suitable thread profile (e.g., API threads, proprietary threads, straight threads, etc.). A central region or section 108 extends along axis 105 between box connector 106 and pin connector 110. The pin connector 110 and box connector 106 may also be referred to herein as "tool joints."

Referring still to FIG. 2, tubular members 100 may also include one or more upsets disposed between ends 100*a*, 100*b*. As used herein, the term "upset" generally refers to an increase in the cross-sectional area at a particular portion of a tubular member (e.g., tubular member 100) relative to the cross-sectional area of an axially adjacent portion of the tubular member. In particular, in this embodiment, the box connector 106 includes an upset 107, and the pin connector 110 includes an upset 111. Thus, the radially outer surface 100*c* is expanded radially outward along the upsets 107, 111 so that the outer diameter of the tubular member 100 is greater along upsets 107, 111 than within the portions of central region 108 that are immediately axially adjacent the upsets 107, 111 (e.g., the portion of central region 108 that is immediately axially downhole of upset 107 and the portion of central region 108 that is immediately axially uphole of upset 111).

In addition, tubular member 100 also includes an upset region 120 (or more simply "upset 120") within the central region 108 so that upset 120 is axially disposed and spaced between threaded connectors 106, 110 (and upsets 107, 111, respectively). Accordingly, the upset 120 separates the central region 108 into a first or upper portion 108*a* extending axially between upset 120 and box connector 106 (particularly upset 107), and a second or lower portion 108*b* extending axially between upset 120 and pin connector 110 (particularly upset 111). The outer diameter of the tubular member 100 is greater along upset 120 than within the upper portion 108*a* and lower portion 108*b* of central region 108. In addition, tubular member 100 may also have an increased wall thickness along upsets 107, 111 of threaded connectors 106, 110, respectively, and along upset 120 as compared with upper portion 108*a* and lower portion 108*a* of central region 108.

Upset 120 may include transitional surfaces 122*a*, 122*b* disposed axially immediately axially adjacent the upper and lower portions 108*a* and 108*b*, respectively, of central region 108 that serve to transition or change the outer diameter of the tubular member 100 from a relative maximum within upset 120 to relative minimums at the portions 108*a*, 108*b* of central region 108. In particular, upset 120 includes a first or upper transitional surface 122*a* that extends to the upper portion 108*a* of central region 108, and a second or lower transitional surface 122*b* that extends to the lower portion 108*b* of central region 108. In some embodiments (e.g., such as the embodiment of FIG. 2), the transitional surfaces 122*a*, 122*b* may comprise frustoconical surfaces; however, transitional surfaces 122*a*, 122*b* may comprise any suitable shape or profile in various embodiments. In some embodiments, transitional surfaces 122*a*, 122*b* may be omitted and radially extending shoulders may be formed at the upper and lower ends of the upset 120.

In some embodiments, upset region 120 may be positioned substantially axially mid-way between ends 100*a*, 100*b*, or threaded connectors 106, 110 (e.g., such that the portions 108*a*, 108*b* of central region 108 have a substantially equal length along axis 105). Alternatively, in some embodiments, upset 120 may be axially closer to one of the upper end 100*a* or lower end 100*b* (e.g., so that portions 108*a*, 108*b* of central region 108 have different, unequal lengths along axis 105). In some embodiments, upset 120 may be generally cylindrical in shape; however, other shapes or profiles are contemplated (e.g., oval, triangular, polygonal, rectangular, square, etc.). In some embodiments, upset 120 may have an outer diameter which is smaller than or substantially equal to the outer diameter of threaded connectors 106, 110 (e.g., such as the outer diameter at the upsets 107, 111). In some embodiments, the outer diameter of tubular member 100 along upset 120 may be at least 0.5 inches larger than an outer diameter of tubular member 100 along the portions 108*a*, 108*b* of central region 108.

Upset 107 and 111 at box connector 106 and pin connector 111, respectively, may be secured to central region 108 via any suitable method, (e.g., welding, integral formation, etc.). For example, in some embodiments, upsets 107, 111 along connectors 106, 110, respectively, are formed by heating ends 100*a*, 100*b* of tubular member 100, and impacting each heated end along axis 105, thereby forcing one or more diameters (e.g., surfaces 100*c*, 100*d*) to radially expand in the manner described above. In addition, in some embodiments upsets 107, 111 may be formed along each end of central region 108 in the manner previously described, and then threaded connectors 106, 110 (which may be formed separately) are be secured (e.g., welded) to the upsets 107, 111.

In addition, upset 120 may also be formed via a forging process whereby one or both of the ends 100*a*, 100*b* are impacted so as to radially expand radially outer surface 100*c* to form upset 120. Further details of the systems and methods for forming upset 120 on tubular member 100 are now described in more detail.

Although one upset 120 is shown in FIG. 2, it is anticipated that a plurality of upsets 120 may be included between ends 100*a*, 100*b*. For instance, a plurality of upsets 120 may be disposed within central region 108 and axially spaced from one another along axis 105.

Figure 3:
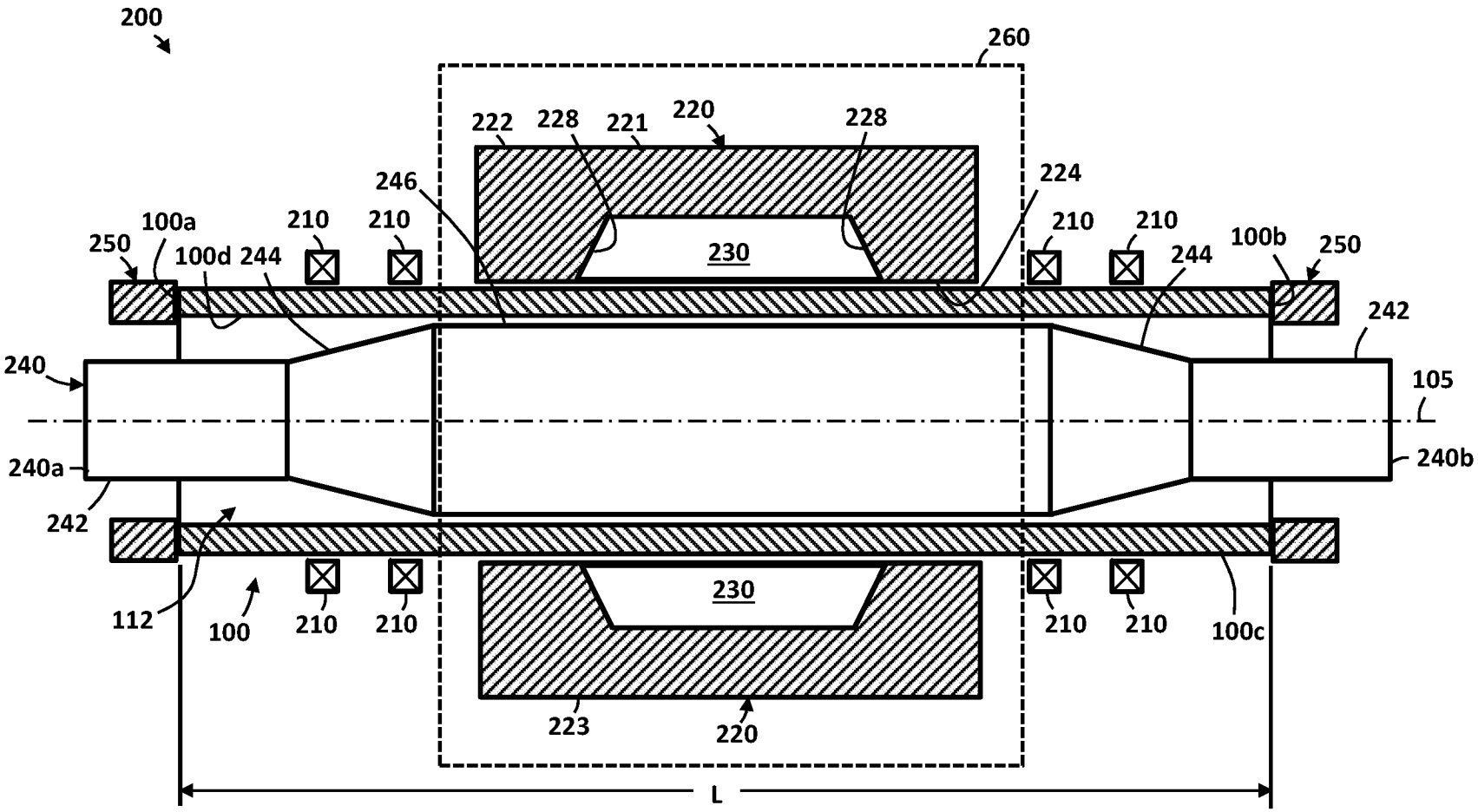
FIGS. 3 and 4 are partial cross-sectional views of a manufacturing system and associated process for forming the tubular member of FIG. 2 according to some embodiments.

Referring now to FIG. 3, a system 200 is shown which may be used to form upset 120 of tubular member 100 as shown in FIG. 2. At the stage of use shown, system 200 has not yet formed upset 120. In addition, at the stage shown in FIG. 3, tubular member 100 also does not include box connector 106 or pin connector 110. Thus, in the view of FIG. 3, radially inner surface 100*d* and radially outer surface 100*c* are both cylindrical in shape, and the wall thickness of tubular member 100 is substantially constant between ends 100*a*, 100*b*.

Generally speaking, system 200 comprises a plurality of anti-buckling guides 210 (or more simply "guides 210") which are configured to support tubular member 100. Guides 210 may be distributed along the length of tubular member 100 and may be configured to support the weight of tubular member 100 horizontally as shown. However, guides 210 may also support tubular member 100 in a vertical orientation in some embodiments, as less bearing loads, friction, and less heat transfer across guides 210 may result. In some embodiments, guides 210 may be positioned proximate to first end 100*a* and second end 100*b* of tubular member and may define a region between guides 210 which is between and axially spaced from first end 100*a* and second end 100*b*. As will be discussed more fully below, tubular member 100 may be axially loaded (e.g., along axis 105 of tubular member 100) with compressive forces during operations with system 200. Thus the placement of guides 210 may be driven by the buckling profile (or expect buckling profile) of tubular member 100 (e.g., guides 210 may be distributed along tubular member 100 so as to prevent or minimize buckling of tubular member 100 as a result of axially applied loads at ends 100*a*, 100*b*).

Referring still to FIG. 3, system 200 further comprises a die assembly 220 which is shown in cross-section. Generally speaking, die assembly 220 may be used to capture a portion of tubular member 100 and confine the radial expansion of radially outer surface 100*c* during the formation of upset region 120, as discussed more fully below. In particular, die assembly 220 comprises a body 221 having a throughbore 224 extending therethrough.

Throughbore 224 is aligned with axis 105 and positioned concentrically around radially outer surface 100*c* of tubular member 100 when tubular member 100 is inserted within throughbore 224 as shown in FIG. 3. In general, throughbore 224 may be shaped so as to form an inner profile matching an outer profile of the central region 108 of tubular member 100 (or at least a portion of the central region 108 that includes upset 120) as shown in FIG. 2 and described above. Thus, throughbore 224 comprises a recess or cavity 230 extending radially away from axis 105 and within body 221, so that an inner diameter of throughbore 224 is generally greater within cavity 230 than along other portions of throughbore 224. Cavity 230 may have any profile or shape, and in some embodiments may be generally cylindrical. As may be appreciated from FIG. 2 (described above), the shape of cavity 230 may correspond to the shape of upset region 120 once fully formed along tubular member 100 (see e.g., FIG. 2). As a result, cavity 230 may include transitional surfaces 228 that serve to transition or change the inner diameter of the throughbore 224 from a relative maximum within cavity 230 to relative minimums at the other portions of throughbore 224 that are axially adjacent (e.g., with respect to axis 105 as shown in FIG. 3) cavity 230. The transitional surfaces 228 may be formed so as to correspond with the transitional surfaces 122*a*, 122*b* of upset 120 (see e.g., FIG. 2). Thus, transitional surfaces 228 may have any suitable shape or arrangement to correspond with the shape of transitional surfaces 122*a*, 122*b*, previously described, and in some embodiments, (e.g., such as in the embodiment of FIG. 3), the transitional surfaces 228 may be generally frustoconical in shape.

In some embodiments, body 221 may be formed as one single-piece monolithic body or as a plurality of segments (e.g., circumferential segments) which may coupled to one another so as to extend circumferentially about tubular member 100. For instance, in the embodiment of FIG. 3, body 221 of die assembly 220 comprises a first segment 222 and a second segment 223 that are coupled to one another so as circumferentially surround tubular member 100.

Referring still to FIG. 3, system 200 may further comprise a mandrel 240 which may be positioned within throughbore 112 of tubular member 100. In particular, mandrel 240 may include a first end 240*a*, a second end 240*b* opposite first end 240*a*, and a mandrel body 246 positioned between the ends 240*a*, 240*b*. Mandrel body 246 may have an outer diameter that is equal or substantially equal to the inner diameter of the tubular member 100 (e.g., within throughbore 112). In some embodiments, the mandrel body 246 may have an outer diameter that is slightly less than the inner diameter of the throughbore 112 so as to allow mandrel body 246 to be slidingly inserted within throughbore 112 along axis 105 during operations. In addition, in some embodiments mandrel body 246 may be selectably expandable (e.g., via an inflatable bladder, hydraulic arms/pistons/etc., or other suitable structure(s)). As a result, in some embodiments, mandrel body 246 may be collapsed or retracted radially inward toward axis 105 when initially inserted within throughbore 112, and then selectively radially expanded to engage with (and potentially exert a desired radially outwardly directed pressure upon) the radially inner surface 100*d* forming throughbore 112 once a desired axial position of mandrel body 246 between ends 100*a*, 100*b* is achieved.

In some embodiments, mandrel body 246 may be generally cylindrical in shape, but may ultimately have any suitable shape that matches a shape of the throughbore 112. A shank 242 may extend axially between mandrel body 246 and first end 240*a* and/or between mandrel body 246 and second end 240*b*. In some embodiments, the shank(s) 242 may have a smaller outer diameter than the mandrel body 246 so that a transitional surface 244 (e.g., frustoconical chamfer, curved radius, etc.) may extend between mandrel body 246 and the shank(s) 242. Mandrel 240 may be positioned within throughbore 112 such that mandrel body 246 is axially overlapped with cavity 230 (e.g., such as shown in FIG. 3).

Some embodiments of system 200 may further include a heater 260, which may include any suitable heat source (e.g., induction coils, resistive coils, combustion burner(s), etc.), wherein heater 260 is configured to heat portions of tubular member 100 at positions between and axially spaced apart from ends 100*a*, 100*b*. As illustrated in FIG. 3, heater 260 may be positioned around the segment of tubular member 100 which is captured within die assembly 220. Accordingly, in some embodiments heater 260 may encompass portions of die assembly 220 or heater 260 may be integrated into die assembly 220. In addition, while not specifically shown, it is anticipated that heater 260 may be readily incorporated into mandrel 240 in some embodiments.

Referring still to FIG. 3, system 200 may further include a ram 250 which may selectably apply compressive forces to one or more of ends 100*a*, 100*b* of tubular member 100 along axis 105. Ram 250 is depicted at both first end 100*a* and second end 100*b*, however, in some embodiments only one ram 250 may be operational at a time. For example ram 250 may apply compressive loads to first end 100*a*, while ram 250 along second end 100*b* may be a stationary anvil which merely provides reactionary forces. In some embodiments, rams 250 may comprise or be coupled to a hydraulic or pneumatic cylinder (or system of such cylinders) that is to apply a force along a desired direction (e.g., along axis 105 as previously described). In some embodiments, rams 250 may be coupled to a suitable driver (electric motor, internal combustion engine, steam engine, hydraulic engine, etc.) that is to drive ram(s) 250 into one or both of the ends 100*a*, 100*b*, so as to apply a suitable compressive load to tubular member 100 along axis 105 during operations. In addition, although rams 250 are depicted in FIG. 3 as being positioned at ends 100*a*, 100*b*, it is anticipated that rams 250 may alternatively apply axial compressive force to tubular member 100 at positions between ends 100*a*, 100*b*. In particular, a gripping arrangement (not specifically shown) may couple to the outer diameter of tubular member 100 (e.g., along radially outer surface 100*c*) at positions between die assembly 220 and ends 100*a*, 100*b*, and rams 250 may apply a compressive force along a desired direction (e.g., along axis 105 as previously described).

Figure 4:
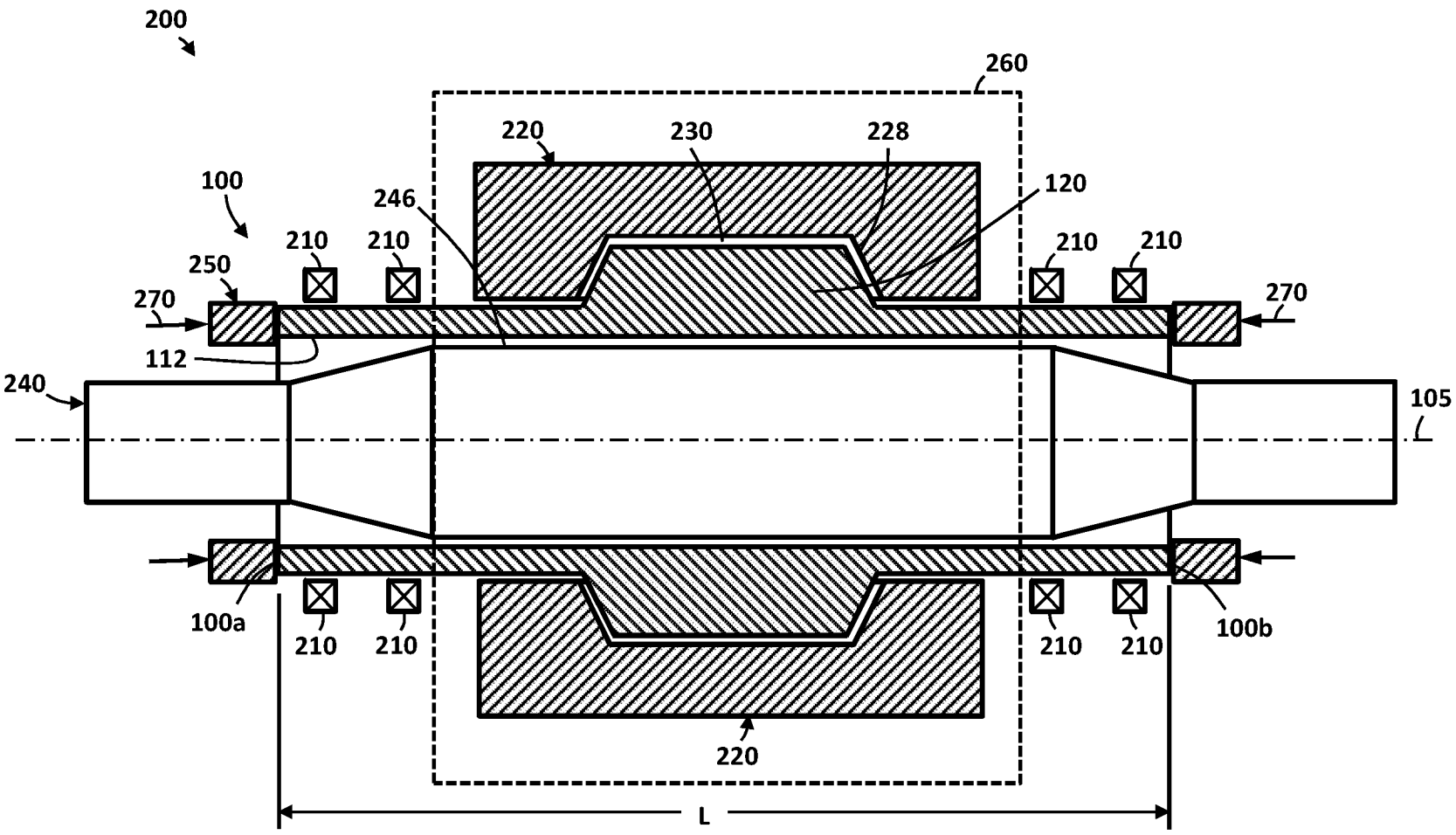

Referring to FIG. 4, system 200 is shown in operation as upset 120 of tubular member 100 has been expanded into cavity 230 of die assembly 220. Generally speaking, system 200 is configured to apply an axial load 270 via ram 250 to at least one of end 100*a*, 100*b* of tubular member 100, and thus cause material from tubular member 100 to be redistributed and flow into cavity 230 of die assembly 220. Axial load 270 may be applied once or may comprise a plurality of sequential loads. In addition, axial load 270 may be an impact load (e.g., as applied by a drop forge) or may be a gradually applied load (e.g., as applied by a press forge). As axial load 270 is applied to ends 100*a*, 100*b* of tubular member 100, a length L of tubular member 100 may be reduced.

Figure 5:
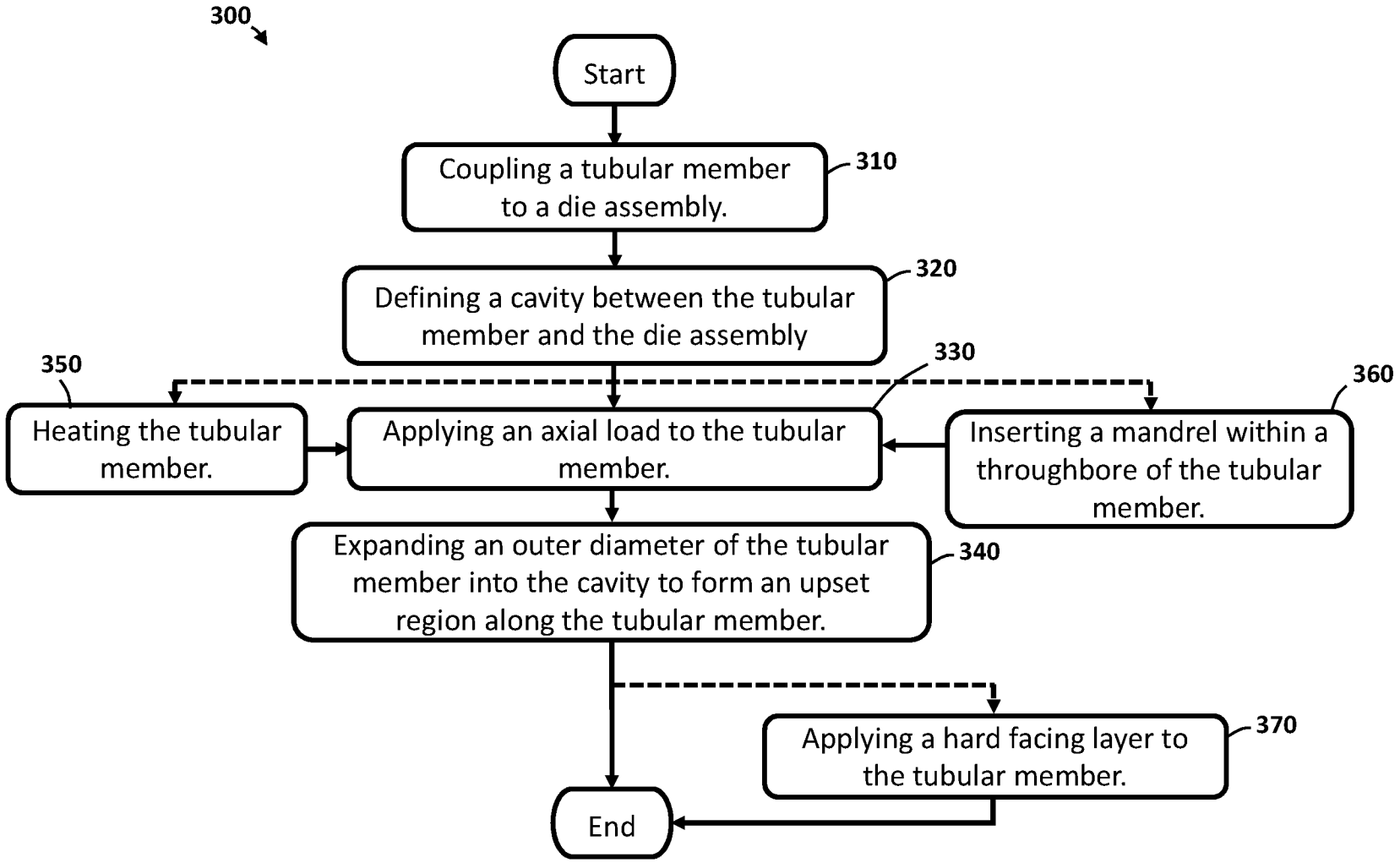
FIG. 5 is a flowchart illustrating a method for manufacturing a tubular member according to some embodiments.

Referring to FIG. 5, a method 300 of using system 200 of FIGS. 3 and 4 is shown. As a result, continuing reference is made to FIGS. 3-4, while describing the features of method 300. Initially, method 300 includes coupling tubular member 100 to a die assembly in block 310. For instance, in the embodiment of FIGS. 3 and 4, tubular member 100 is inserted within throughbore 224 of die assembly 220 (or segments 222, 223 of die assembly 230 may be coupled about tubular member 100 as previously described). As a result, a portion (or all) of the tubular member 100 is captured within die assembly 220.

Returning to FIG. 5, method 300 next includes defining a cavity between the tubular member and the die assembly at block 320. For instance, in the embodiment of FIGS. 3 and 4, a cavity 230 is defined within throughbore 224, between tubular member 100 and die assembly 220.

Next, method 300 of FIG. 5 includes applying an axial load to the tubular member at block 330. For instance, as described above for the embodiment of FIGS. 3 and 4, once tubular member 100 is disposed within throughbore 224 of die assembly 220 an axially oriented compressive load (e.g., along axis 105) may be applied to one or both of the ends 100*a*, 100*b* of tubular member 100 so as to radially expand the radially outer surface 100*c* into the cavity 230 as previously described. During block 330, a plurality of guides (e.g., guides 210) may engage with the tubular member 100 to prevent buckling and therefore maintain substantial alignment of throughbore of the tubular member (e.g., throughbore 112) along a central axis (e.g., axis 105).

Prior to applying the axial load at block 330, some embodiments of method 300 may also comprise heating tubular member at block 350 and/or inserting a mandrel within a throughbore of the tubular member at block 360. For instance, for the embodiment of FIGS. 3 and 4, block 350 may comprise using a heater (e.g., heater 260 and/or a heater or heating assembly that is separate and independent of system 200) to heat tubular member 100. In some embodiments, tubular member 100 may be heated before and/or after inserting the tubular member 100 within the throughbore 224 of die assembly 220 (e.g., at blocks 310, 320 previously described above).

In addition, for the embodiment of FIGS. 3 and 4, block 360 may comprise inserting mandrel 240 within throughbore 112 of tubular member 100. As previously described, the mandrel (or some portion thereof—such as, e.g., the mandrel body 246) may be axially overlapped or aligned with the cavity 230 (e.g., the cavity defined at block 320).

Referring again to FIG. 5, method 300 also includes expanding an outer diameter of the tubular member into the cavity to form an upset region (e.g., upset region 120) along the tubular member at block 340. For instance, as previously described, expanding the outer diameter of the tubular member into the cavity at block 340 may occur as a result of the axial load applied to the tubular member at block 330. Specifically, for the embodiment of FIGS. 3 and 4, the axial load applied to end 100*a* and/or end 100*b* of tubular member 100 may redistribute material of tubular member 100 into cavity 230 so as to form upset 120. In some embodiments, the outer diameter of tubular member 100 may be increased by at least 0.5 inches within the upset 120 as a result of applying the axial load at end 100*a* and/or end 100*b*.

In addition, for embodiments of method 300 that include inserting a mandrel (e.g., mandrel 240) within the throughbore of the tubular member 360 as previously described, as the axial load is applied at block 330 and the outer diameter of the tubular member is expanded into the cavity at block 340, the inner diameter of the tubular member (e.g., within the throughbore 112) may be maintained by the mandrel (e.g., by mandrel body 246 for the embodiment of FIGS. 3 and 4) so that an inner diameter within the tubular member may be maintained substantially constant along its length (e.g., within +/−10% of a nominal value in some embodiments).

Figure 6:
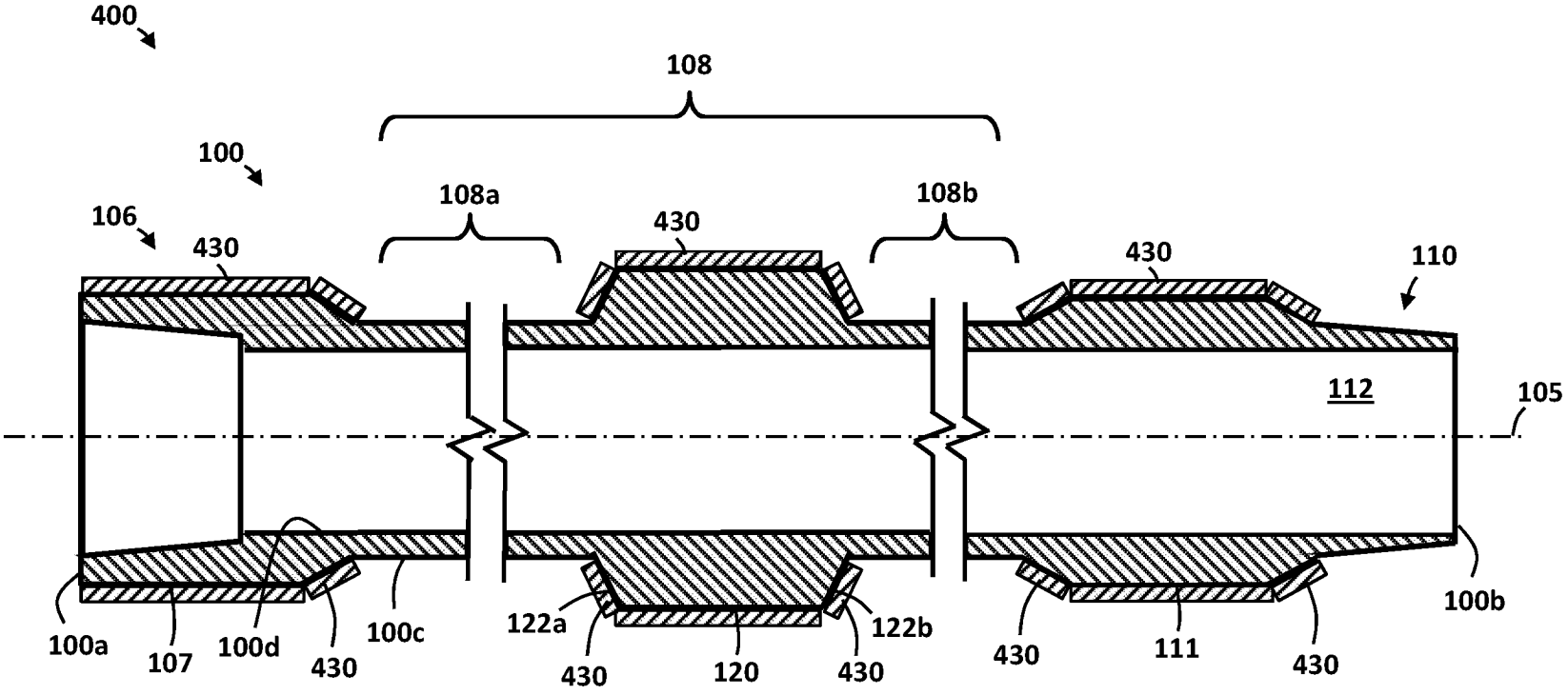
FIG. 6 is a cross-sectional view of a tubular member for use within the drilling system of FIG. 1, according to some embodiments.

Referring again to FIG. 5, in some embodiments, method 300 may also comprise applying a hardfacing layer on the tubular member at block 370 after expanding the outer diameter at block 340. For instance, in some embodiments, a hardfacing layer may be applied to the upset region formed at block 340 (e.g., upset region 120). Specifically, brief reference is now made to FIG. 6 which depicts the tubular member 100 of FIG. 2, but additionally shows one or more hard facing layers 430 applied to various surfaces of tubular member 100. In particular, tubular member 400 may comprise hard facing layers 430 disposed on the upsets 107, 111, 120. For the upset 120, the hard facing may be disposed along the transitional surfaces 122*a*, 122*b*, or may be disposed along the portions of upset 120 that are axially disposed between the transitional surfaces 122*a*, 122*b*. Any suitable hard facing material (e.g., tungsten carbide, polycrystalline diamond, etc.) may be used within the hard facing layers 430. In addition, any suitable method for applying the hard facing layers 430 may be used in various embodiments (e.g., metal spray, welding, etc.).

Accordingly, method 300 may produce a tubular member having an upset along a central region thereof (e.g., such as upset region 120 within central region 108 as shown in FIG. 2). In some embodiments, the upset region may have a homogeneous material phase with the rest of the tubular member (e.g., such as with the other portions 108*a*, 108*b* of central region 108 for the tubular member 100 in FIG. 2). In addition, the upset region 120 may not include a welded seam or joint (e.g., such that the connection between the upset region 120 and the rest of the tubular member is "free from discontinuities" and may be referred to as "jointless").

Referring again to FIGS. 1 and 2, during a drilling operations, one or more of the tubular members 100 may be coupled together to form drill string 2 so that axes 105 of tubular member(s) 100 are aligned with axis 5. Thereafter, as drill string 2 (or a portion thereof) is rotated about axis 5, tubular member(s) 100 within drill string 2 may engage (e.g., impact, shear, etc.) the wall of borehole 12. Due to the placement (e.g., along axis 105 between ends 100*a*, 100*b*) and relatively larger outer diameter of upsets 120, the engagement between the tubular members 100 and the wall of borehole 12 may take place along upset regions 120 (and also threaded connectors 106, 110). However, the increased wall thickness at the upsets 120 (and as well as upsets 107, 111) may allow these regions/surfaces to withstand a greater amount of wear during drilling operations. As a result, the upsets 120 may provide tubular member 100 with a greater service life and durability than standard a tubular member.

Further, because the upset 120 is formed on tubular member 100 via a forging process as shown in FIGS. 3 and 4 (e.g., via system 200), the connection between the upset regions 120 and the remaining portion of each tubular member 100 is free from discontinuities (and is free of welded joints) as previously described above.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The invention claimed is:

1. A method, the method comprising:

(a) coupling a tubular member to a die assembly, wherein the tubular member includes a central axis, a first end, a second end opposite the first end, and an upset region between and axially spaced from the first end and the second end;

(b) defining a cavity between the die assembly and the upset region during (a);

(c) inserting a mandrel within an inner diameter of the tubular member, wherein the mandrel comprises:

a mandrel body having an outer diameter that is substantially equal to the inner diameter of the tubular member; and a shank having an outer diameter that is smaller than the outer diameter of the mandrel body, wherein inserting the mandrel within the inner diameter of the tubular member comprises positioning the mandrel body and the shank within the tubular member and aligning the mandrel body with the cavity;

(d) applying an axial load to the tubular member after (a)-(c); and (e) expanding an outer diameter of the tubular member into the cavity along the upset region during (c).

2. The method of claim 1, wherein the upset region is positioned substantially axially mid-way between the first end and the second end of the tubular member.

3. The method of claim 1, wherein (e) comprises expanding the outer diameter of the tubular member by at least 0.5 inches.

4. The method of claim 1, wherein (e) comprises changing an inner diameter of the tubular member along the upset region less than 10%.

5. The method of claim 1, further comprising (f) heating the tubular member before (d).

6. The method of claim 1, further comprising (f) applying a hard facing layer after (d) to the expanded outer diameter of the tubular member.

7. The method of claim 1, wherein the axial load of (d) is applied to at least one of the first end or the second end of the tubular member.

8. The method of claim 7, wherein the axial load of (d) comprises a plurality of impacts on the tubular member.

* * * * *